US007198274B2

(12) United States Patent
Cho

(10) Patent No.: US 7,198,274 B2
(45) Date of Patent: Apr. 3, 2007

(54) PORTABLE NET DEVICE

(76) Inventor: Kwang Han Cho, 148 S. Gramercy Pl., #16, Los Angeles, CA (US) 90004

( * ) Notice: Subject to any disclaimer, the term of this patent is extended or adjusted under 35 U.S.C. 154(b) by 0 days.

(21) Appl. No.: 10/711,564

(22) Filed: Sep. 24, 2004

(65) Prior Publication Data

US 2006/0068943 A1 Mar. 30, 2006

(51) Int. Cl.
*A63B 63/00* (2006.01)

(52) U.S. Cl. ..... 273/400; 473/476; 473/197; 473/454

(58) Field of Classification Search ..... 273/398–403; 473/476, 478, 197, 454
See application file for complete search history.

(56) References Cited

U.S. PATENT DOCUMENTS 4,905,996 A * 3/1990 Tallent et al. ..... 473/197
5,088,740 A * 2/1992 Peterson ..... 273/410
D403,386 S 12/1998 Cho
5,976,023 A 11/1999 Cho
D418,883 S 1/2000 Cho
6,135,894 A 10/2000 Cho
D441,040 S 4/2001 Cho
6,312,343 B1 11/2001 Cho
6,554,717 B2 4/2003 Cho
2003/0203775 A1 10/2003 Wong

* cited by examiner

*Primary Examiner*—Mark S. Graham
(74) *Attorney, Agent, or Firm*—John K. Park; Park Law Firm

(57) ABSTRACT

Disclosed is a portable net device comprising a main member forming a first closed loop, a base member forming a second closed loop and defined by front and non-front sections where a main member bottom section is attached to the base member front section, a fabric member having front and non-front sections where the fabric member front section is connected to the main member, a connecting member to selectively attach the fabric member non-front section to the base member non-front section in a detachable attachment format, and a supporting member to sustain the main member against the base member while maintaining a substantial angle between the main and base members.

26 Claims, 3 Drawing Sheets

PORTABLE NET DEVICE

BACKGROUND OF THE INVENTION

This invention relates to an athletic ball game net. More specifically, the present invention relates to an improved portable net device applying thereto an adjustable net mechanism, thereby expanding usability further to baseball catching, hockey ball catching, and soccer ball catching.

Conventional athletic ball game nets on the market typically focus on practicing ball games in a limited space. For example, As demand goes on known for are utility realizing an enhanced application a variety of ball catching a variety of ball ca ball catching net which enhances portability and efficiently stops the flight of golf balls.

For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground. A disadvantage of such structure is limited application. Further, it is easily folded and efficiently stored. This is because both the support frame and the capturing frame must be properly folded and placed in a container. Further use of a capturing frame and a supporting frame makes such structures more expensive to manufacture and harder to carry. There is, therefore, a need for a stable practice net applicable to a variety of balls. There is also a need for such a net to be easy to assemble and easy to carry.

SUMMARY OF THE INVENTION

The present invention is contrived to overcome the conventional disadvantages. Accordingly, it is an object of the present invention employing an adjustable net mechanism. Another object is to expand usability further to baseball catching, hockey ball catching, and soccer ball catching. A further object is to provide a portable net device which facilitates assembly and disassembly by simplifying the construction and enhancing portability.

To achieve these and other objects, the portable net device according to the present invention comprises a main member forming a first closed loop with the main member defined by bottom and top sections. A base member forming a second closed loop is defined by a front section and a non-front section. The main member bottom section is attached to the base member front section. A fabric member having a front section and a non-front section. The fabric member front section is connected to the main member to flexibly stop the flight of projectiles. A connecting member is provided to selectively attach the fabric member non-front section to the base member non-front section in a detachable attachment format. Further provided is a supporting member to sustain the main member against the base member while maintaining a substantial angle between the main and base members.

For a better performance, the main member has a plurality of corners each in arc so as to shape the first closed loop in a substantial polygon, whereas the base member has a plurality of corners each in arc so as to shape the second closed loop in a substantial polygon. In this construction, a fabric retainer is preferably formed adjacent to each of the corners to maintain the polygon in shape.

Specifically, the farbic member front section is connected near to the upper end of the main member and the farbic member non-front section is selectively attached near to the rear end of the base member non-front section with the connecting member or detached from the base member non-front section so that the farbic member is selectively pulled diagonally between the main member and the base member, or becomes draped toward the first closed loop.

In another embodiment, the fabric member non-front section is selectively attached the between the front end and the rear end of the base member non-front section with the connecting member or detached from the base member non-front section.

The net device further a patch attachedly sided to the main and base members. The patch has a guide to support the supporting member. The guide is preferably a sleeve to allow passage of the supporting member. The main and base members are each coilable to overlapping loops.

The connecting member is a hook detachably attached to the fabric member non-front section and releasably hooked to the base member non-front section. Selectively, the connecting member is provided such that the hook is detachably attached to the base member non-front section and releasably hooked to the fabric member non-front section.

A target net portion may be detachably attached across the first closed loop to the main member to have a central basket net therethrough to allow passage of the flight of the projectiles. The net device may also include a main sleeve substantially covering the main member, and a base sleeve substantially covering the base member. The main sleeve has main holes and the base sleeve has base holes so the main and base holes removably carry therein ends of the supporting member.

The advantages of the present invention are numerous. First, the portable net device according to the present invention employs an adjustable mechanism for attachment of the fabric member to the base member so as to expand usability to baseball catching, hockey ball catching and soccer ball catching. Second, a pair of coilable main and base members are foldably connected to each other and coilably overlapped in multiple loops, respectively, thereby further facilitating storage, assembly and disassembly of the net device. Third, the patch sleeve receiving therethrough the supporting member together with each the substantial polygonal format of the main and base members secures stability of the main member against the base member, thereby enhancing product reliability and user satisfaction.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
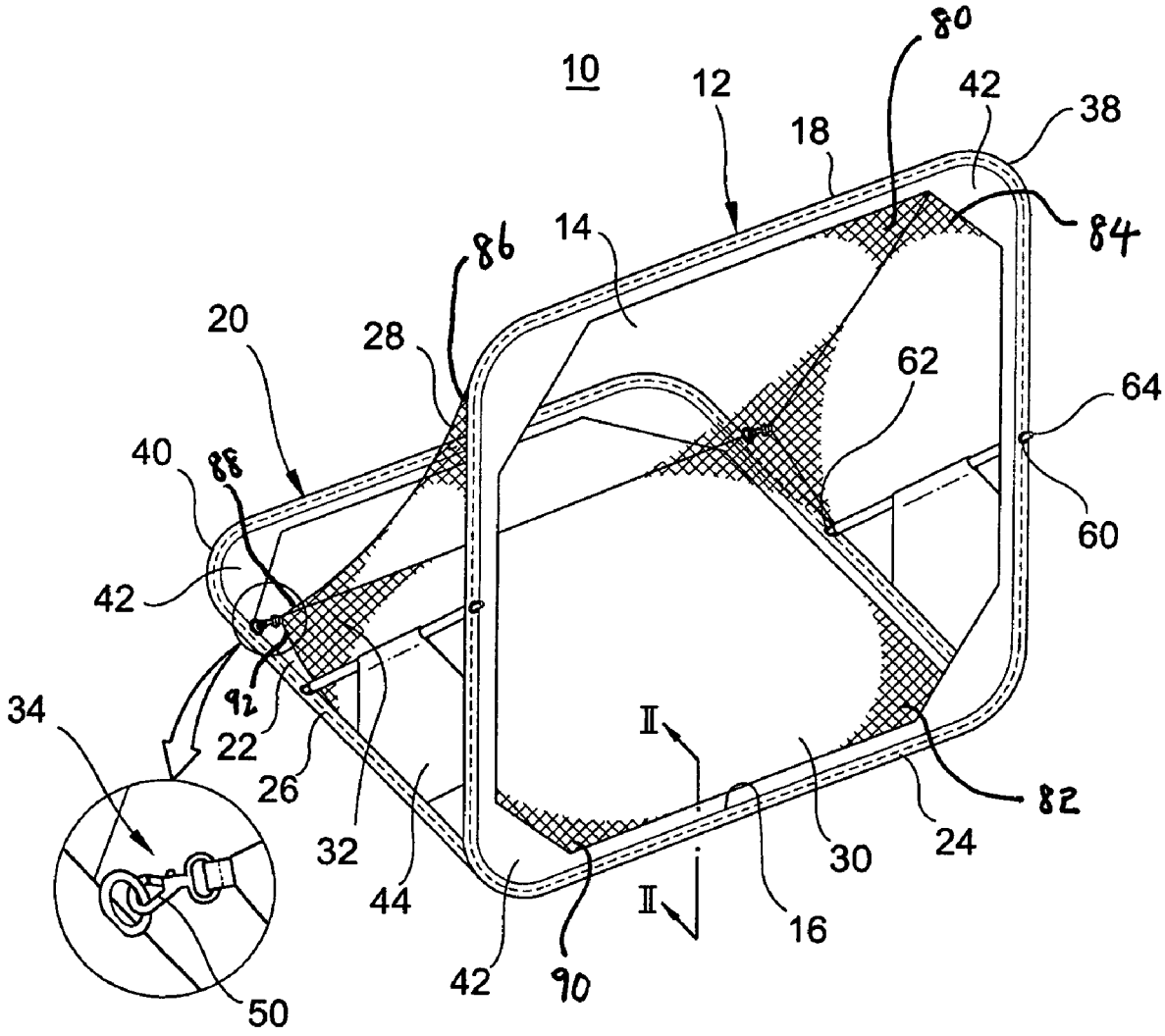
FIG. 1 is a perspective view illustrating a portable net device according to a first embodiment of the present invention.

FIG. 1 shows a perspective view of a portable net device 10. As shown therein, the net device 10 comprises a main member 12 forming a first closed loop 14. The main member 12 is defined by bottom and top sections 16, 18. In order to match with the main member 12, a base member 20 is provided to form a second closed loop 22 in a substantially similar shape with the main member 12.

Figure 2:
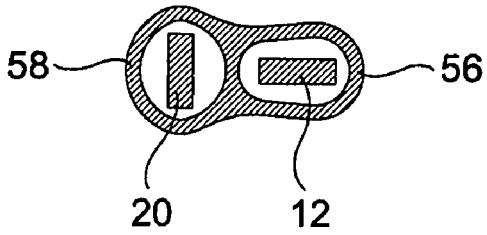
FIG. 2 is a cross-sectional view taken along II—II in FIG. 1.

The base member 20 is defined by a front section 24 and a non-front section 26. In this construction, the main member bottom section 16 is attached to the base member front section 24 so that the main member 12 can be angularly raised against the base member 20 while maintaining a partial attachment of the main and base members 12, 20. FIG. 2 shows a cross-section taken along II—II in FIG. 1. As wherein therein, the main and base members 12, 20 are each fabric-covered so that the main member 12 is carried in a main sleeve 56, and the base member 20 is carried in the base sleeve 58.

A fabric member 28 is provided to have a front section 30 and a non-front section 32 where the fabric member front section 30 is connected to the main member 12 to flexibly stop the flight of projectiles (not shown). The fabric member 28 is preferably formed of a net in a baggy format. To improve usability, the net device 10 further comprises a connecting member 34 to selectively attach the fabric member non-front section 32 to the base member non-front section 26 in a detachable attachment format. The fabric member 28 may form a net fabrication, where threads are interwoven or knotted together to form a plurality of meshes. The fabric member 28 may be formed of a material such as synthetic cloth or natural cloth.

Figure 3:
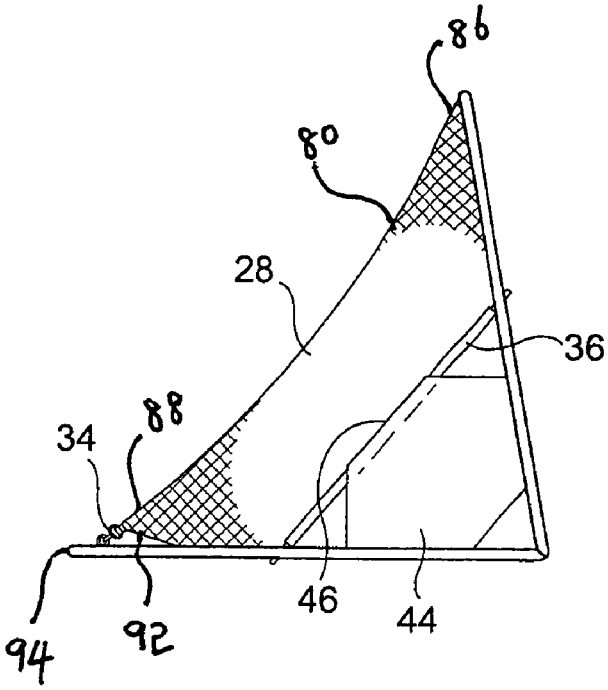
FIGS. 3 and 4 are side views of the portable net device.
Figure 4:
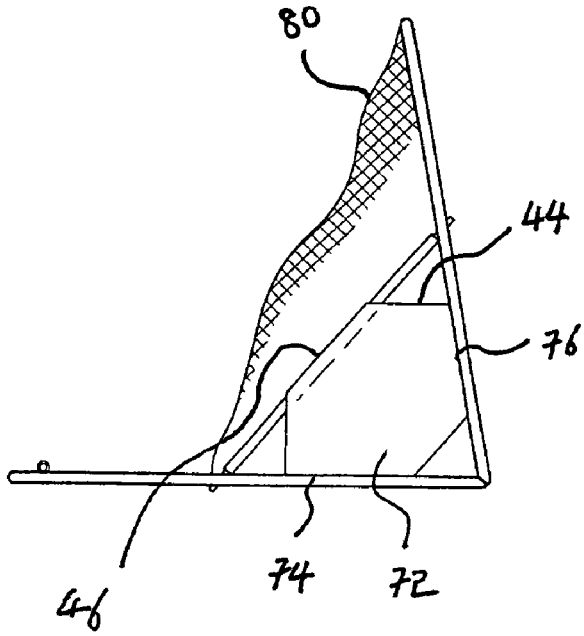

With reference to FIGS. 3 and 4, the connecting member 34 is provided to improve product applicability. For example, when the non-front section 32 of the fabric member 28 is attached to the non-front section 26 of the base member 20 the net device 10 can be used for soccer ball catching in soccer ball games or ball kicking practice. On the other hand, when the connecting member 34 is released from the rear end engagement, that is, when the non-front section 26 of the base member 20 is detached from its attachment to the non-front section 32 of the fabric member 28, the fabric member 28 becomes draped toward the first closed loop 14 formed by the main member 12, whereby the net device 10 serves to efficiently stop, for example, the flight of a baseball.

Although the net 28 itself carries a reasonable elasticity in stopping the flight of a larger ball the fabric member 28 draped closer to the main member 12 functions much better in stopping the flight of a relatively smaller ball like a baseball. The closer draping of the fabric member 28 to the main member 12 further carries a substantial extent of ball retrieval characteristics.

For a better performance, the connecting member 34 is preferably formed of a hook 50. The hook 50 is detachably attached to the fabric member non-front section 32 and releasably hooked to the base member non-front section 26. Alternately, the hook 50 is detachably attached to the base member non-front section 26 and releasably hooked to the fabric member non-front section 32.

In order to stabilize the upward posture of the main member 12, the net device 10 also comprises a supporting member 36 to sustain the main member 12 against the base member 20 while maintaining a substantial angle between the main and base members 12, 20. Here, the main and base members 12, 20 are rotably attached to each other around the respective bottom and front sections 16, 24 of the main and base member 12, 20.

Figure 5:
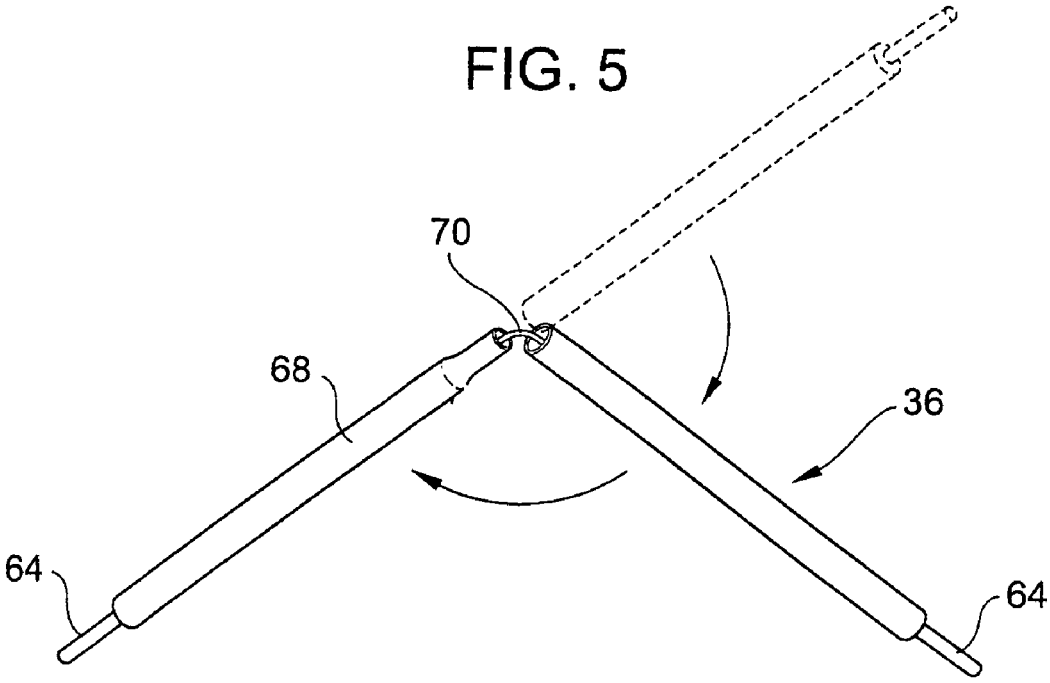
FIG. 5 is a construction view showing a supporting member in FIG. 1.

As further shown in FIG. 5, the supporting member 36 is formed of a pair of rods 68 whose ends 64 become removably, correspondingly carried in the main and base holes 60, 62. As shown therein, the rods 68 are each elastically detachable to two pieces which remain connected by an elastic string 70 provided in the respective rods 68. This way, the supporting member 36 can be easily dissembled to the smaller pieces to facilitate storage.

In a preferred version, the net device 10 also includes a main sleeve 56 substantially covering the main member 12, and a base sleeve 58 substantially covering the base member 20. The main sleeve 56 has main holes 60 and the base sleeve has base holes 62 such that the main and base holes 60, 62 removably carry therein ends 64 of the supporting member 36 to increase stability of the net device 10.

Together with the supporting member 36 there is provided a patch 44 to secure a desired angle between the main and base members 12, 20 while enhancing stability of the raised-up posture of the main member 12 against the base member 20. The patch 44 is attachedly sided to the main and base members 12, 20 around each bottom and front section 16, 24 of the main and base members 12, 20. Preferably, the patch 44 has a guide 46 to support the supporting member 36 where the guide 46 is formed of a sleeve to allow passage of the supporting member 36 while providing an additional stability to the supporting member 36. With the patch 44 provided in the portable net device 10, the preferred angle by the main and base member 12, 20 is between about 40 degrees and slightly less than 90 degrees so that the main and base members 12, 20 can be maintained at a substantially erected but tilted position.

In an embodiment, the main member 12 has a plurality of corners 38 each in arc so as to shape the first closed loop 14 in a substantial polygon, and the base member 20 has a plurality of corners 40 each in arc so as to shape the second closed loop in a substantial polygon. To realize each polygonal formation of the main and base members 12, 20 the portable net device 10 comprises a fabric retainer 42 formed adjacent to each of the corners 38, 40 so as to maintain the polygon in shape. The best mode of the polygonal formation is a substantial square format.

Figure 6:
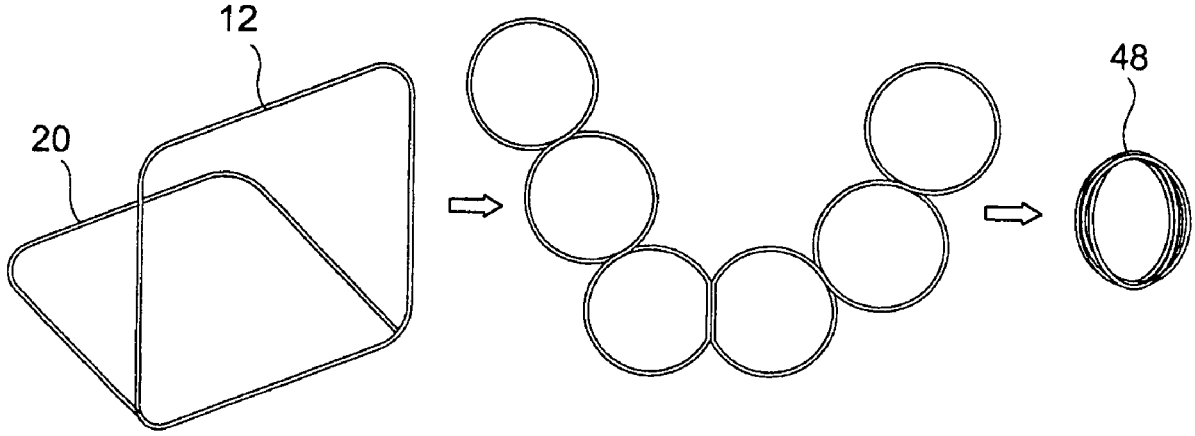
FIG. 6 is a schematic view showing a coiling mechanism of the portable net device.

FIG. 6 shows a storage mechanism applied to the portable net device 10. As shown therein, for better storage and dissembling purposes, the main and base members 12, 20 are each formed in a coilable format so that the main and base members 12, 20 are each coilable to overlapping loops 48. Preferably, the main and base members 12, 20 are each coiled in twofold or threefold to the overlapping loops 48 to facilitate storage and portability. For assembly into the usable net device 10, the overlapped loops 48 can be simply released for elastic pop-up setting to the polygonal formation. Then, the main member 12 is raised and supported by the supporting member 36 carried in the patch sleeve 46.

Referring to FIG. 4, the patch includes a substantially thin patch body 72. The patch body 72 includes a base side 74 that is attached to the base member 20, and a main side 76 that is attached to the main member 12. The sleeve 46 is provided between the base side 74 and the main side 76 of the patch body 72.

The main and base members 12, 20 may be formed of an elastic material so as to facilitate the assembly and the coiled overlapping for disassembly. For disassembly of the net device 10, the supporting member 36 can be simply removed, and the main and base members 10, 20 are twisted and coiled into a plurality of overlapping loops 48. Accordingly, the pair of coiled members 12, 20 can be easily stored in the storage bag (not shown).

Figure 7:
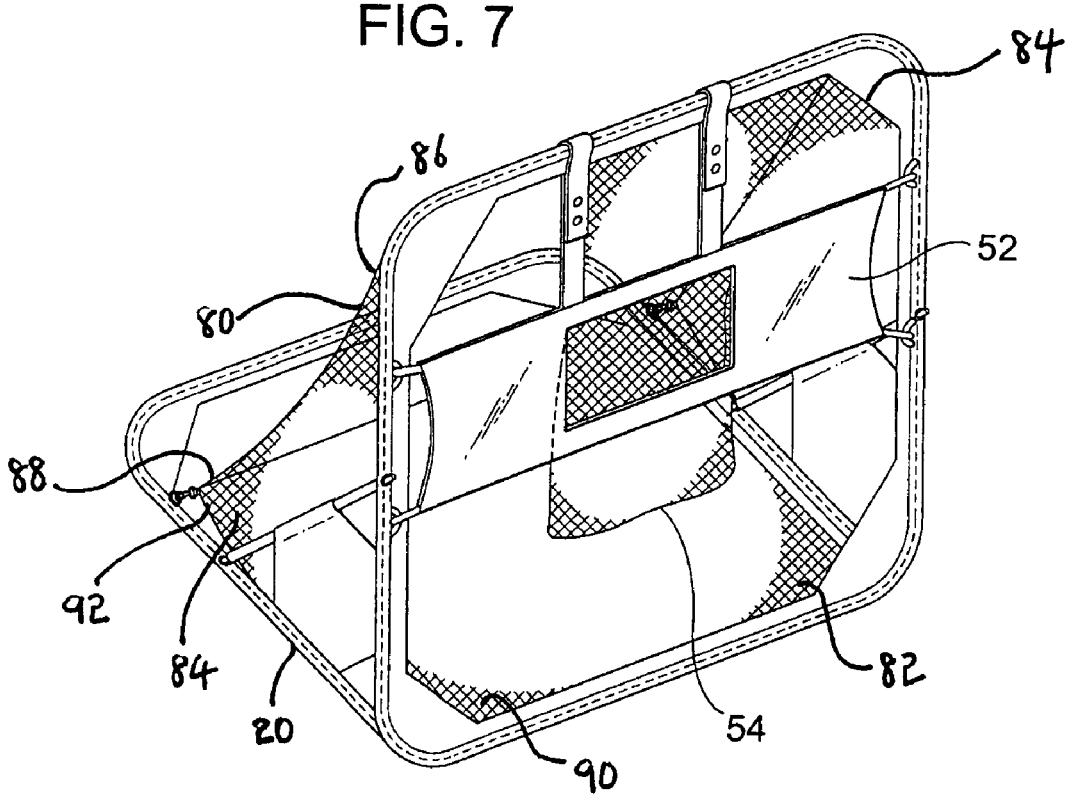
FIG. 7 is a view illustrating the portable net device according to a second embodiment of the present invention.

FIG. 7 shows the net device 10 with a target net portion 52. As shown therein, the target net portion 52 is detachably attached across the first closed loop 14 to the main member 12. The target net portion 52 has a central basket net 54 therethrough to allow passage of the flight of the projectiles.

As discussed above, an advantage of the present invention is that the portable net device 10 employs an adjustable mechanism for attachment of the fabric member 28 to the base member 20 so as to expand usability to baseball catching, hockey ball catching and soccer ball catching. Further, the pair of coilable main and base members 12, 20 are foldably connected to each other and coilably overlapped in multiple loops, respectively, threreby further facilitating storage, assembly and disassembly of the net device 10.

In addition, the patch sleeve 46 receiving therethrough the supporting member 36 in combination with the substantial polygonal format of the main and base members 12, 20 secures stability of the main member 12 against the base member 20, thereby enhancing product reliability and user satisfaction.

Although the present invention has been described in considerable detail with reference to certain preferred versions thereof, other versions are possible by converting the aforementioned construction. Therefore, the scope of the invention shall not be limited by the specification specified above and the appended claims.

Referring FIGS. 1, 3 and 7, further details regarding how the farbic member 28 is attached to the base member 20 is explained.

The non-front section 32 of the farbic member 28 includes a upper farbic portion 80, a lower farbic portion 82, and two side farbic portions 84 that connect the upper farbic portion 80 and the lower farbic portion 82 whereby the farbic member 28 has a baggy shape.

The upper farbic portion 80 includes a front end 86 and a rear end 88. The lower farbic portion 82 includes a front end 90 and a rear end 92. The front end 86 of the upper farbic portion 80 and the front end 90 of the lower farbic portion 82 are connceted to the main member 12. The rear end 88 of the upper farbic portion 80 and the rear end 92 of the lower farbic portion 82 are adjacent or coincide with each other.

The rear end 88 of the upper farbic portion 80 and the rear end 92 of the lower farbic portion 82 are selectively attached near to the rear end 94 of the base member non-front section 26 with the connecting member 34, or detached from the base member non-front section 26 whereby the farbic member 28 is selectively pulled diagonally between the main member 12 and the base member 20, or becomes draped toward the first closed loop 14.

What is claimed is:

1. A portable net device comprising:

a) a main member forming a first closed loop, wherein the main member is defined by bottom and top sections;

b) a base member forming a second closed loop, wherein the base member is defined by a front section and a non-front section, wherein the main member bottom section is attached to the base member front section;

c) a fabric member having a front section and a non-front section, wherein the fabric member front section is connected to the main member to flexibly stop the flight of projectiles;

d) a connecting member to selectively attach the fabric member non-front section to the base member non-front section in a detachable attachment format; and e) a supporting member to sustain the main member against the base member while maintaining a substantial angle between the main and base members;

wherein the fabric member comprises a upper fabric portion, a lower fabric portion, and two side fabric portions that connect the upper fabric portion and the lower fabric portion whereby the fabric member has a baggy shape, wherein the upper fabric portion comprises a front end and a rear end, wherein the lower fabric portion comprises a front end and a rear end, wherein the front end of the upper fabric portion and the front end of the lower fabric portion are connected to the main member, wherein the rear end of the upper fabric portion and the rear end of the lower fabric portion are adjacent or coincide with each other, wherein the rear end of the upper fabric portion and the rear end of the lower fabric portion are selectively attached near to the rear end of the base member non-front section with the connecting member, or detached from the base member non-front section whereby the fabric member is selectively pulled diagonally between the main member and the base member, or becomes draped toward the first closed loop.

2. The portable net device of claim 1 further comprising a patch attachedly sided to the main and base members, wherein the patch has a guide to support the supporting member, wherein the patch comprises a substantially thin patch body, the patch body comprises a base side that is attached to the base member, and a main side that is attached to the main member, wherein the guide is a sleeve to allow passage of the supporting member, wherein the sleeve is provided between the base side and the main side of the patch body.

3. The portable net device of claim 1 wherein the main and base members are each coilable.

4. The portable net device of claim 3 wherein the main and base members are each coilable to overlapping loops.

5. The portable net device of claim 1 wherein the connecting member is a hook detachably attached to the fabric member non-front section and releasably hooked to the base member non-front section.

6. The portable net device of claim 1 wherein the connecting member is a hook detachably attached to the base member non-front section and releasably hooked to the fabric member non-front section.

7. The portable net device of claim 1 further comprising a target net portion detachably attached across the first closed loop to the main member, wherein the target net portion has a central basket net therethrough to allow passage of the flight of the projectiles.

8. The portable net device of claim 1 further comprising:

a) a main sleeve substantially covering the main member; and b) a base sleeve substantially covering the base member.

9. The portable net device of claim 7 wherein the main sleeve has main holes and the base sleeve has base holes, wherein the main and base holes removably carry therein ends of the supporting member.

10. The portable net device of claim 8 wherein the supporting member is a pair of rods whose ends become removably, correspondingly carried in the main and base holes.

11. The portable net device of claim 9 wherein the rods are each elastically detachable to two pieces which remain connected by an elastic string provided in the respective rods.

12. The portable net device of claim 1, wherein the fabric member is pulled tight between the main member and the base member, when the rear end of the upper fabric portion and the rear end of the lower fabric portion are attached near to the rear end of the base member non-front section with the connecting member.

13. A portable net device comprising:

a) a main member forming a first closed loop, wherein the main member has a plurality of corners each in arc so as to shape the first closed loop in a substantial polygon, wherein the main member is defined by bottom and top sections;

b) a base member forming a second closed loop, wherein the base member has a plurality of corners each in arc so as to shape the second closed loop in a substantial polygon, wherein the base member is defined by a front section and a non-front section, wherein the main member bottom section is attached to the base member front section;

c) a fabric member having a front section and a non-front section, wherein the fabric member front section is connected to the main member to flexibly stop the flight of projectiles;

d) a connecting member to selectively attach the fabric member non-front section to the base member non-front section in a detachable attachment format; and e) a supporting member to sustain the main member against the base member while maintaining a substantial angle between the main and base members;

wherein the fabric member comprises a upper fabric portion, a lower fabric portion, and two side fabric portions that connect the upper fabric portion and the lower fabric portion whereby the fabric member has a baggy shape, wherein the upper fabric portion comprises a front end and a rear end, wherein the lower fabric portion comprises a front end and a rear end, wherein the front end of the upper fabric portion and the front end of the lower fabric portion are connected to the main member, wherein the rear end of the upper fabric portion and the rear end of the lower fabric portion are adjacent or coincide with each other, wherein the rear end of the upper fabric portion and the rear end of the lower fabric portion are selectively attached near to the rear end of the base member non-front section with the connecting member, or detached from the base member non-front section whereby the fabric member is selectively pulled diagonally between the main member and the base member, or becomes draped toward the first closed loop.

14. The portable net device of claim 13 further comprising a fabric retainer formed adjacent to each of the corners to maintain the polygon in shape.

15. The portable net device of claim 13 further comprising a patch attachedly sided to the main and base members, wherein the patch has a guide to support the supporting member, wherein the patch comprises a substantially thin patch body, the patch body comprises a base side that is attached to the base member, and a main side that is attached to the main member, wherein the guide is a sleeve to allow passage of the supporting member, wherein the sleeve is provided between the base side and the main side of the patch body.

16. The portable net device of claim 13 wherein the main and base members are each coilable.

17. The portable net device of claim 16 wherein the main and base members are each coilable to overlapping loops.

18. The portable net device of claim 13 wherein the connecting member is a hook detachably attached to the fabric member non-front section and releasably hooked to the base member non-front section.

19. The portable net device of claim 13 wherein the connecting member is a hook detachably attached to the base member non-front section and releasably hooked to the fabric member non-front section.

20. The portable net device of claim 13 further comprising a target net portion detachably attached across the first closed loop to the main member, wherein the target net portion has a central basket net therethrough to allow passage of the flight of the projectiles.

21. The portable net device of claim 13 further comprising:

a) a main sleeve substantially covering the main member; and b) a base sleeve substantially covering the base member.

22. The portable net device of claim 21 wherein the main sleeve has main holes and the base sleeve has base holes, wherein the main and base holes removably carry therein ends of the supporting member.

23. The portable net device of claim 22 wherein the supporting member is a pair of rods whose ends become removably, correspondingly carried in the main and base holes.

24. The portable net device of claim 23 wherein the rods are each elastically detachable to two pieces which remain connected by an elastic string provided in the respective rods.

25. The portable net device of claim 13, wherein the fabric member is pulled tight between the main member and the base member, when the rear end of the upper fabric portion and the rear end of the lower fabric portion are attached near to the rear end of the base member non-front section with the connecting member.

26. A portable net device comprising:

a) a main member forming a first closed loop, wherein the main member is defined by bottom and top sections;

b) a base member forming a second closed loop, wherein the base member is defined by a front section and a non-front section, wherein the main member bottom section is attached to the base member front section;

c) a fabric member having a front section and a non-front section, wherein the fabric member front section is connected to the main member to flexibly stop the flight of projectiles;

d) a connecting member to selectively attach the fabric member non-front section to the base member non-front section in a detachable attachment format; and e) a supporting member to sustain the main member against the base member while maintaining a substantial angle between the main and base members;

wherein the fabric member comprises a upper fabric portion, a lower fabric portion, and two side fabric portions that connect the upper fabric portion and the lower fabric portion whereby the fabric member has a baggy shape, wherein the upper fabric portion comprises a front end and a rear end, wherein the lower fabric portion comprises a front end and a rear end, wherein the front end of the upper fabric portion and the front end of the lower fabric portion are connected to the main member, wherein the rear end of the upper fabric portion and the rear end of the lower fabric portion are adjacent or coincide with each other, wherein the rear end of the upper fabric portion and the rear end of the lower fabric portion are selectively attached between the front end and the rear end of the base member non-front section with the connecting member, or detached from the base member non-front section whereby the fabric member is selectively pulled diagonally between the main member and the base member, or becomes draped toward the first closed loop.

* * * * *